United States Patent [19]

Zollinger

[11] 4,226,265

[45] Oct. 7, 1980

[54] WITHDRAWING CARRIER FOR LOOMS WITH REMOVAL OF THE FILLING THREAD FROM STATIONARY BOBBINS

[75] Inventor: Hans Zollinger, Tann-Rüti, Switzerland

[73] Assignee: Rüti Machinery Works Ltd., Rüti, Switzerland

[21] Appl. No.: 8,543

[22] Filed: Feb. 1, 1979

[30] Foreign Application Priority Data

Feb. 28, 1978 [CH] Switzerland ..... 2130785/78

[51] Int. Cl.[3] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 3,901,284 | 8/1975 | Riolet | 139/448 |
| 3,998,251 | 12/1976 | Hadam | 139/448 |
| 4,062,382 | 12/1977 | Rohr et al. | 139/448 |

FOREIGN PATENT DOCUMENTS

| | | | |
|---|---|---|---|
| 131386 | 6/1978 | German Democratic Rep. | 139/448 |

*Primary Examiner*—Henry Jaudon

*Attorney, Agent, or Firm*—Werner W. Kleeman

[57] ABSTRACT

A withdrawing carrier for looms with removal of the filling thread from stationary bobbins, the carrier having a hook and a pivotal clamping tongue. An additional clamping element is provided for augmenting the clamping action exerted by the clamping tongue upon the filling thread.

10 Claims, 8 Drawing Figures

WITHDRAWING CARRIER FOR LOOMS WITH REMOVAL OF THE FILLING THREAD FROM STATIONARY BOBBINS

BACKGROUND OF THE INVENTION

The present invention relates to a new and improved construction of withdrawing carrier or taker-gripper for looms with removal of the filling thread or the like from stationary bobbins, the carrier being of the type comprising a hook having a pivotable or swingable clamping tongue.

Taker-grippers or withdrawing carriers of this type are used at gripper looms. These taker-grippers serve to engage the filling thread which has been withdrawn by an inserting carrier or bringer-gripper from a stationary bobbin and introduced approximately to the center of the shed and to draw the thus engaged filling thread through the second half of the shed. After departure of the taker-gripper out of the shed the clamped filling thread is released.

With a state-of-the-art taker-gripper of the previously mentioned type, as known for instance from the commonly assigned U.S. Pat. No. 4,062,382, granted Dec. 13, 1977, it is possible that, notwithstanding faultless functioning of the clamping tongue, the filling thread during its transport through the second half of the shed is suddenly released by the gripper, and thus, is not completely inserted into the shed. This malfunction appears to be attributable to vibrations of the taker-gripper during the insertion of the filling thread. These vibrations can be transmitted to the clamping tongue and can undesirably cause pivoting of the clamping tongue, and thus, premature release of the filling thread.

SUMMARY OF THE INVENTION

Therefore, with the foregoing in mind it is a primary object of the present invention to provide a new and improved construction of withdrawing carrier of the previously mentioned type which extensively eliminates the aforementioned drawbacks and shortcomings of the prior art carriers discussed above.

Another and more specific object of the present invention aims at improving the heretofore known carriers or grippers in a manner such that malfunctions of the previously mentioned type can be positively avoided, so that the filling thread is no longer unintentionally released by the gripper.

Yet a further significant object of the present invention aims at the provision of a new and improved construction of withdrawing carrier for the filling thread of gripper looms, which carrier is relatively simple in design, economical to manufacture, extremely reliable in operation, and incorporates mechanism for augmenting the clamping action exerted by the clamping tongue, to thereby beneficially avoid, or at the very least extensively minimize, the possibility of premature release of the filling thread during its insertion through the shed of the loom.

Now in order to implement these and still further objects of the invention, which will become more readily apparent as the description proceeds, the carrier of the present invention, which is of the type comprising a hook and a swingable or pivotable clamping tongue, contemplate the provision of an additional clamping element for the filling thread in order to augment the clamping action exerted by the clamping tongue upon the filling thread.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
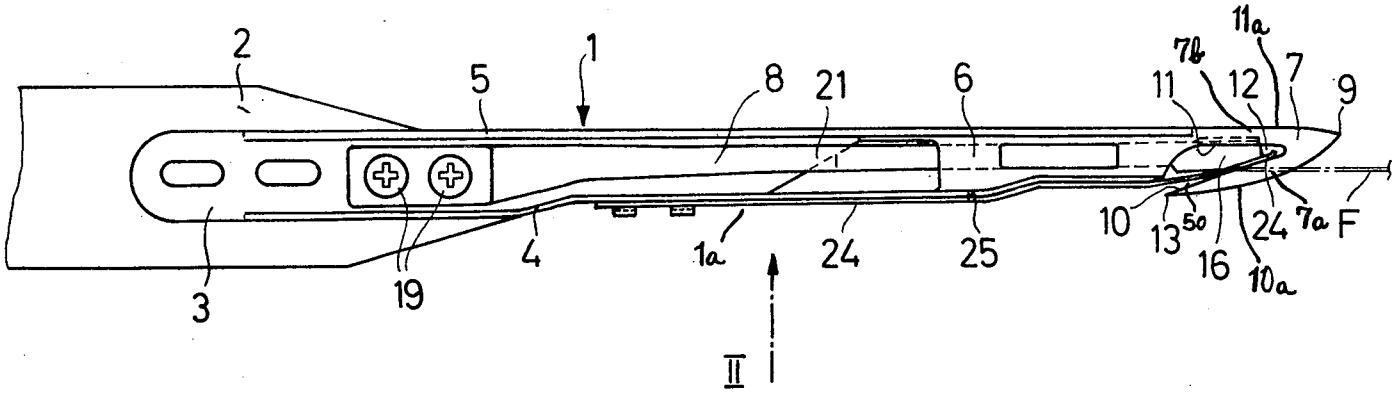
FIG. 1 is a top plan view of a withdrawing carrier or taker-gripper according to the invention.
Figure 2:
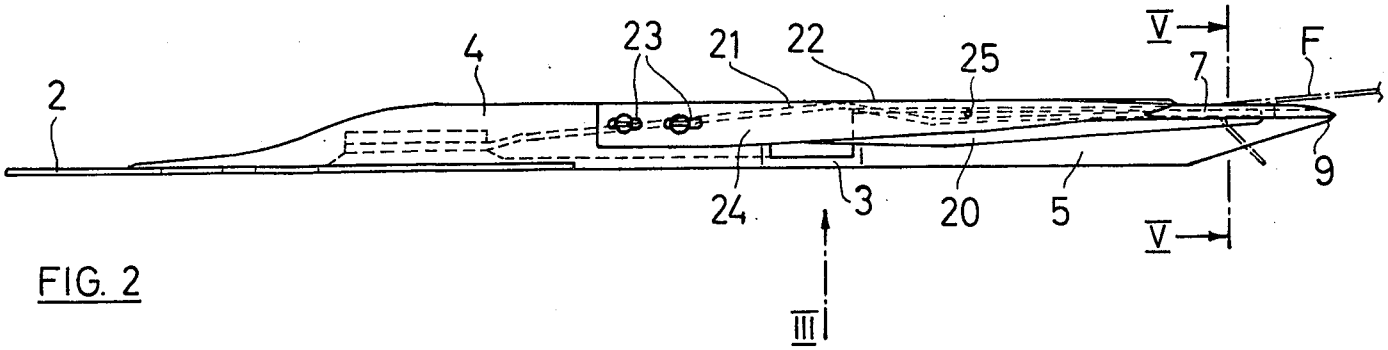
FIG. 2 is a view of the withdrawing carrier, looking in the direction of the arrow II of FIG. 1.
Figure 3:
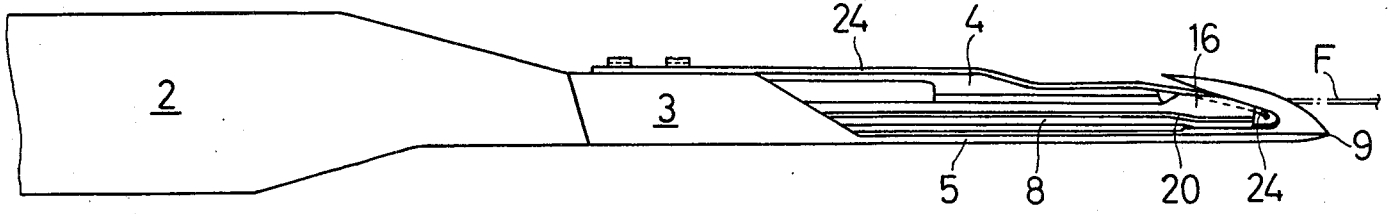
FIG. 3 is a view of the withdrawing carrier, looking in the direction of the arrow III of FIG. 2.
Figure 4:
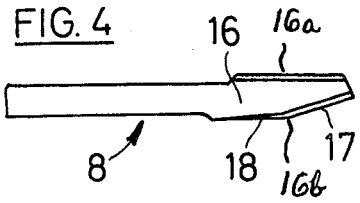
FIG. 4 is a fragmentary detail top plan view of the clamping tongue of the withdrawing carrier shown in FIG. 1.

Describing now the drawings, the withdrawing carrier or taker-gripper 1, illustrated by way of example in FIGS. 1 to 5, will be seen to be mounted on the front end of a flexible band 2 of a carrier or gripper type loom, this flexible band 2 serving for driving the withdrawing carrier or taker-gripper 1 in its back and forth motion during the operation of the loom, as is well known in this art. The withdrawing carrier 1 comprises a hollow gripper body or body member, generally indicated in FIG. 1 by reference character 1*a*, of rectangular cross-section. This hollow gripper body 1*a* comprises a base plate 3, a front side wall 4 which faces the cloth fell, a rear side wall 5 and a web or strap 6 or equivalent structure which interconnects both of the side walls 4 and 5. The rear side wall 5 and the web 6 extend towards the gripper or carrier tip and terminate at an essentially flat hook 7. Within the hollow body 1*a*, which is surrounded by the base plate 3, side walls 4 and 5 and web 6, there is arranged an elongate or lengthwise extending, flat and resilient clamping tongue 8. This clamping tongue 8 is mounted such that it can swing or pivot perpendicular to the plane of the hook 7, and specifically in such a manner that, in relation to the showing of FIG. 1, the free end of the clamping tongue 8 swings or rocks below the plane of the drawing of FIG. 1.

The withdrawing carrier or taker-gripper 1, during operation of the loom, is inserted for instance from the left-hand side of the shed. The flexible band or tape 2 and the plane of the hook 7 are then dispositioned essentially parallel to the central plane of the warp threads (not shown).

The hook 7 is open at the front side wall 4. Both of the outer edges or surfaces 10*a* and 11*a* of the hook arms 7*a* and 7*b*, respectively, terminate at the hook tip 9, whereas the inner edges or surfaces, designated by reference characters 10 and 11, of both hook arms 7*a* and 7*b*, respectively, limit the hook mouth 12. The end of the hook 7 is designated by reference character 13. The inner edges or surfaces 10 and 11 of both hook arms 7a and 7b are each provided with a respective stepped portion 14 and 15 (FIG. 5), and specifically, in such a manner that the hook mouth 12 is narrower at the upper side than at the lower side of the hook 7.

Continuing, it will be seen that the clamping tongue 8 protrudes by means of its free end 16 into the hook mouth 12, and specifically into its wider portion 12a located at the underside of the hook 7. The rear lengthwise edge 16a (FIG. 4) of the clamping tongue end 16, and which faces away from the cloth fell, serves as a guide edge, while the front lengthwise edge, generally designated by reference character 16b in FIG. 4, together with the stepped or recessed portion 14 of the hook inner edge 10 forms a clamping gap 50 for a filling thread F. The free end 16 of the clamping tongue 8 is beveled or angled at its front longitudinal edge 16b and contains at such region a clamping surface 17 of larger slope for thicker threads or yarns and a clamping surface 18 of smaller slope for thinner threads or yarns. These two clamping surfaces 17 and 18 can smoothly merge into one another.

Furthermore, the clamping tongue 8 has a substantially trapezoidal cross-section at the region of its end 16 and the inner edges 10 and 11 of the hook 7 are correspondingly wedgeshaped at the region of their stepped or recessed portions 14 and 15. In this way, there is beneficially realized a double wedging action at the clamping gap 50, by virtue of which the filling thread F, on the one hand, is always positively clamped and, on the other hand, upon release of the clamping action exerted by the clamping tongue 8 is also rapidly released.

The clamping tongue 8 is preferably formed of one piece, for instance forged, and is threadably connected at its one end by screws 19 or equivalent fastening expedients to the base plate 3. At its underside or bottom the clamping tongue 8 is provided with a stiffening or reinforcement rib 20 extending in its lengthwise direction. Moreover, this clamping tongue 8 possesses such an initial tension or pre-bias that its end 16 is upwardly pressed against the stepped or recessed structure 14, 15 provided at the hook mouth 12. A clamping tongue of this type has been disclosed in detail in the aforementioned, commonly assigned U.S. Pat. No. 4,062,382, to which reference may be readily had and the disclosure of which is incorporated herein by reference.

Now in order to release the clamping action it is necessary, following insertion of the filling thread F, to apply a downwardly acting force at the clamping tongue 8, so that the end 16 will swing or pivot downwards. For this purpose, the top surface of the clamping tongue 8 is provided with a substantially wedge-shaped ascending control surface 21 approximately at the intermediate region between the screws 19 and the hook mouth 12. Upon departure of the hook tip 9 and thus the filling thread F out of the shed, this control surface 21 comes into contact with a release element which is stationarily mounted at the loom, for instance a camming surface (not shown), and thus, such control surface 21 together with the clamping tongue 8 is downwardly pivoted or rocked. The amplitude of such pivoting or swinging motion is limited in downward direction by the base plate 3 of the withdrawing carrier or taker-gripper 1.

During the weaving of heavy fabrics, it might happen that the pressure of the warp threads in the shed upon the control surface 21 is sufficient in order to downwardly pivot or swing the clamping tongue 8. This is prevented by the front side wall 4 of the withdrawing carrier 1 inasmuch as the upper edge 22 of such front side wall 4 is structured as a thread repelling or deflection edge which serves to space the warp threads from the control surface 21.

A further disturbance possibility which can arise during weaving, and in fact has already arisen, is the unintentional release of the filling thread F by the withdrawing carrier 1 owing to vertical oscillations of the clamping tongue which are caused by impact of the withdrawing carrier or gripper 1 against its guide arrangement. This disturbance or malfunction possibility is beneficially eliminated in that, at the region of the clamping gap 50 there is provided an additional clamping element which augments or assists the clamping action of the clamping tongue 8. This additional clamping element, to be considered in greater detail shortly, is likewise resiliently structured as the clamping tongue 8 and can act either directly upon the filling thread F in that it additionally clamps the same, as shown in the embodiments of FIGS. 5 and 6, or else it can act upon the clamping tongue 8 and secure such against unintentional pivoting of this clamping tongue 8 out of the hook mouth 12, as shown with the embodiments of FIGS. 7 and 8.

With the embodiment shown in FIGS. 1 to 5, the additional clamping element is formed by a clamping spring 24 or equivalent structure which is threadably connected for displacement in the lengthwise direction of the gripper at the front side wall 4 by means of the elongate holes 23 and coacting fixing screws or the like. This clamping spring 24, defining the additional clamping element, extends into the hook mouth 12, as best seen by referring for instance to FIG. 1. Furthermore, this clamping spring 24 is pre-biased or tensioned such that it presses against the hook inner edge 10 and is pivotable or swingable in the plane of the hook 7 and thus perpendicular to the pivot or swing plane of the clamping tongue 8. At the front side wall 4 there is inserted a guide pin 25 or equivalent structure which piercingly extends through a not particularly referenced bore of the clamping spring 24 and thus additionally guides such clamping spring 24.

Figure 5:
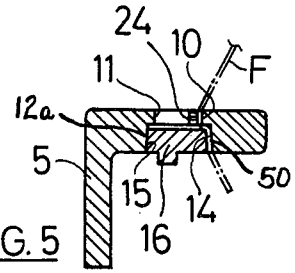
FIG. 5 is an enlarged sectional view, taken substantially along the line V—V of FIG. 2.

In the arrangement shown in FIG. 5 the clamping spring 24 is disposed in the hook mouth 12 above the clamping tongue 8 and presses against the hook inner edge 10 above the stepped or recessed portion 14.

Figure 6:
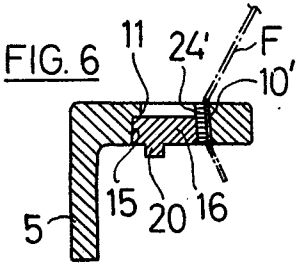

With the somewhat modified exemplary embodiment of FIG. 6, wherein there will be particularly highlighted the differences from the arrangement of FIG. 5, the clamping spring 24' extends through the hook mouth 12 over essentially its entire vertical extent. Due to this construction it is possible to dispense with the stepped portion 14 shown in the arrangement of FIG. 5, since now the filling thread F is clamped between the clamping spring 24' and the inner edge 10' and the clamping tongue 8 presses by means of its clamping surface 17 against the clamping spring 24' constituting the additional clamping element.

Figure 7:
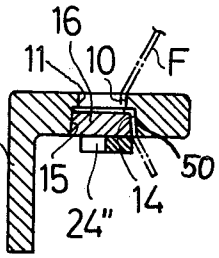
FIGS. 6 and 7 are analogous sectional views, similar to that shown in FIG. 5, but portraying respective modified embodiments of the withdrawing carrier.
Figure 8:
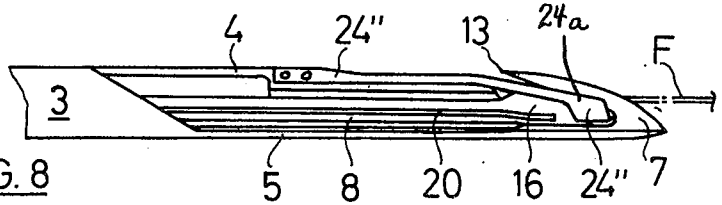
FIG. 8 is a fragmentary view, similar to the showing of FIG. 3, showing details of the variant embodiment portrayed in FIG. 7.

With the further modified embodiment, illustrated in FIGS. 7 and 8, the clamping spring 24'', again consituting the additional clamping element, is arranged below the clamping tongue 8 and like such clamping tongue is also pivotable or swingable in vertical direction. This clamping spring 24'' presses from below against the clamping tongue 8 and thus secures such against any unintentional swinging out or pivoting in the downward direction. Here the clamping spring 24" is fixed, for instance screwed, to the lower edge of the front side wall 4, extends relatively narrowly up to the clamping gap, so that it does not hinder the insertion of the filling thread F, and finally, possesses at its front end a widened portion 24*a* by means of which it presses against the clamping tongue 8.

Having now had the benefit of the description of the various proposed exemplary embodiments of withdrawing carrier there will now be considered its mode of operation, which is as follows: The withdrawing carrier or taker-gripper 1 is transported by its drive band 2 from the left-hand side of the loom up to approximately the center of the shed and at that location, at the region of the hook tip 9, comes against the filling thread F by means of the front outer edge or surface 10*a* of the hook 7. This filling thread F has been offered by a not particularly shown inserting carrier or bringer-gripper in a position where it extends essentially perpendicular to the plane of the hook 7. The withdrawing carrier or gripper 1 moves into the inserting carrier or bringer-gripper. The filling thread F, which is still fixedly retained by the inserting gripper, slides over the front outer edge 10*a* of the hook 7 and the hook end 13 in the direction of the clamping gap or slot 50. During the outward movement of the withdrawing carrier 1 out of the shed the filling thread F arrives at the clamping gap or slot 50 and, specifically, up to the region thereof which essentially corresponds to its thickness. At this point in time there is released in any conventional manner, as is known in this technology, the clamping action at the inserting carrier, and the filling thread F which has now been fixedly clamped by the withdrawing carrier 1, and specifically by the clamping tongue 8 and/or the clamping spring 24 or 24' is drawn by such withdrawing carrier 1 through the second half of the shed. After insertion of the filling thread has been completed, the clamping action upon the filling thread, exerted by the withdrawing carrier, is released in the already described manner.

Due to the compactness of the withdrawing carrier or taker-gripper 1 it is particularly suitable for use with looms at which there are employed as the gripper drive flexible bands or tapes of the type shown in the figures of the drawings. But, of course, the withdrawing carrier 1 can also be employed on rigid insertion bars or the like.

While there are shown and described present preferred embodiment of the invention, it is to be distinctly understood that the invention is not limited thereto, but may be otherwise variously embodied and practiced within the scope of the following claims. ACCORDINGLY,

What I claim is:

1. A withdrawing carrier for looms with removal of the filling thread from stationary bobbins comprising:

means providing a gripper body for the withdrawing carrier, a hook having a hook mouth for receiving a filling thread to be engaged and provided for said gripper body;

a pivotable clamping tongue cooperating with said hook for exerting a clamping action upon a filling thread located in said hook mouth;

an additional clamping element for augmenting the clamping action exerted by said clamping tongue; and said additional clamping element comprising a clamping spring extending essentially in the lengthwise direction of the gripper body.

2. The withdrawing carrier as defined in claim 1, wherein:

said hook embodies two arms;

each arm having an inner edge;

said inner edges of said two arms enclosing said look mouth;

one of the inner edges being provided with a stepped portion configured such that the hook mouth has a narrower portion at the top region of the hook than at the bottom region of the hook;

means for pivotably mounting the clamping tongue for movement perpendicular to a plane containing said hook;

said clamping tongue protruding into the wider portion of the hook mouth;

the other inner edge of said hook being provided with a stepped portion;

said stepped portion of said other inner edge of said hook together with a neighboring edge of said clamping tongue forming a clamping gap for the filling thread;

means mounting said clamping spring to be pivotable in said pivot plane of said clamping tongue; and said clamping spring being located at the region of said hook mouth below said clamping tongue and being pre-biased towards a lower edge of said clamping tongue.

3. The withdrawing carrier as defined in claim 1, further including:

means mounting said clamping tongue to be pivotable in a predetermined pivot plane; and means mounting said clamping spring to be pivotable in said pivot plane of said clamping tongue.

4. The withdrawing carrier as defined in claim 1, wherein:

said hook embodies two arms;

each arm having an inner edge;

said inner edges of said two arms enclosing said hook mouth;

one of the inner edges being provided with a stepped portion configured such that the hook mouth has a narrower portion at the top region of the hook than at the bottom region of the hook;

means for pivotably mounting the clamping tongue for movement perpendicular to a plane containing said hook; and said clamping tongue protruding into the wider portion of the hook mouth.

5. The withdrawing carrier as defined in claim 4, wherein:

the other inner edge of said hook is provided with a stepped portion;

said stepped portion of said other inner edge of said hook together with a neighboring edge of said clamping tongue forming a first clamping gap for the filling thread.

6. A withdrawing carrier for looms with removal of the filling thread from stationary bobbins comprising:

means providing a gripper body for the withdrawing carrier;

a hook having a hook mouth for receiving a filling thread to be engaged and provided for said gripper body;

a pivotable clamping tongue cooperating with said hook for exerting a clamping action upon a filling thread located in said hook mouth;

an additional clamping element for augmenting the clamping action exerted by said clamping tongue;

said additional clamping element comprising a clamping spring extending essentially in the lengthwise direction of the gripper body;

means mounting said clamping tongue for pivotable movement in a predetermined pivot plane; and means mounting said clamping spring to be pivotable essentially perpendicular to said pivot plane of said clamping tongue.

7. The withdrawing carrier as defined in claim 6, wherein:

said hook embodies two arms;

each arm having an inner edge;

said inner edges of said two arms enclosing said hook mouth;

one of the inner edges being provided with a stepped portion configured such that the hook mouth has a narrower portion at the top region of the hook than at the bottom region of the hook;

means for pivotably mounting the clamping tongue for movement perpendicular to a plane containing said hook;

said clamping tongue protruding into the wider portion of the hook mouth;

the other inner edge of said hook being provided with a stepped portion;

said stepped portion of said other inner edge of said hook together with a neighboring edge of said clamping tongue forming a first clamping gap for the filling thread;

said clamping spring being located at the region of the hook mouth above the clamping tongue and being pre-biased towards the other inner edge of the hook at the narrower portion of the hook mouth; and said other inner edge together with said clamping spring forming a second clamping gap for the filling thread.

8. The withdrawing carrier as defined in claim 6, wherein:

said hook embodies two arms;

each arm having an inner edge;

said inner edges of said two arms enclosing said hook mouth;

one of the inner edges being provided with a stepped portion configured such that the hook mouth has a narrower portion at the top region of the hook that at the bottom region of the hook;

means for pivotably mounting the clamping tongue for movement perpendicular to a plane containing said hook;

said clamping tongue protruding into the wider portion of the hook mouth;

said clamping spring, at the region of the hook mouth, being located between the other inner edge of the hook and an edge of the clamping tongue neighboring said other inner edge of the hook;

said clamping spring being pre-biased towards said other inner edge; and said other inner edge together with said clamping spring forming a clamping gap for the filling thread.

9. A withdrawing carrier for looms with removal of the filling thread from stationary bobbins comprising:

means providing a gripper body for the withdrawing carrier;

a hook having a hook mouth for receiving a filling thread to be engaged and provided for said gripper body;

a pivotable clamping tongue cooperating with said hook for exerting a clamping action upon a filling thread located in said hook mouth;

an additional clamping element for augmenting the clamping action exerted by said clamping tongue;

said additional clamping element comprises a clamping spring extending essentially in the lengthwise direction of the gripper body;

said hook embodies two arms;

each arm having an inner edge;

said inner edges of said two arms enclosing said hook mouth;

one of the inner edges being provided with a stepped portion configured such that the hook mouth has a narrower portion at the top region of the hook than at the bottom region of the hook;

means for pivotably mounting the clamping tongue for movement perpendicular to a plane containing said hook;

said clamping tongue protruding into the wider portion of the hook mouth;

the other inner edge of said hook is provided with a stepped portion;

said stepped portion of said other inner edge of said hook together with a neighboring edge of said clamping tongue forming a first clamping gap for the filling thread;

means mounting said clamping tongue for pivotable movement in a predetermined pivot plane;

means mounting said clamping spring to be pivotable essentially perpendicular to said pivot plane of said clamping tongue;

said clamping spring being located at the region of the hook mouth above the clamping tongue and being pre-biased towards the other inner edge of the hook at the narrower portion of the hook mouth; and said other inner edge together with said clamping spring forming a second clamping gap for the filling thread.

10. A withdrawing carrier for looms with removal of the filling thread from stationary bobbins comprising:

means providing a gripper body for the withdrawing carrier;

a hook provided for the gripper body and having means for receiving a filling thread to be engaged;

a movable clamping member cooperating with said hook for exerting a clamping action upon a filling thread located in said filling thread-receiving means;

a clamping element for assisting the clamping action exerted by said clamping member; and said clamping element being separated from and acting independently of said clamping member.

* * * * *